US008574089B1

(12) United States Patent
Bova

(10) Patent No.: US 8,574,089 B1
(45) Date of Patent: Nov. 5, 2013

(54) BILLIARDS RACK SYSTEM AND METHOD OF USE

(71) Applicant: William Bova, Parkersburg, WV (US)

(72) Inventor: William Bova, Parkersburg, WV (US)

( * ) Notice: Subject to any disclaimer, the term of this patent is extended or adjusted under 35 U.S.C. 154(b) by 0 days.

(21) Appl. No.: 13/764,856

(22) Filed: Feb. 12, 2013

Related U.S. Application Data

(63) Continuation of application No. 13/269,722, filed on Oct. 10, 2011, now abandoned.

(51) Int. Cl.
*A63D 15/00* (2006.01)

(52) U.S. Cl.
USPC ..... 473/40

(58) Field of Classification Search
USPC ..... 473/40, 41, 21, 26, 1; D21/782
See application file for complete search history.

(56) References Cited

U.S. PATENT DOCUMENTS

| | | | | | |
|---|---|---|---|---|---|
| 294,200 | A * | 2/1884 | Collender | 473/41 |
| 501,256 | A * | 7/1893 | Bohrbach | 473/41 |
| 1,089,140 | A * | 3/1914 | Madigan | 473/40 |
| 1,093,123 | A * | 4/1914 | Coyette | 473/41 |
| 1,161,324 | A * | 11/1915 | Matthay | 482/44 |
| 1,299,471 | A * | 4/1919 | Hornbostel | 473/40 |
| 1,660,626 | A * | 2/1928 | Rhoads | 473/40 |
| 1,725,494 | A * | 8/1929 | Varnum | 473/40 |
| 4,553,750 | A * | 11/1985 | Kintz | 473/40 |
| 4,591,051 | A * | 5/1986 | Lowman | 206/315.9 |
| 5,031,918 | A * | 7/1991 | Brill | 273/288 |
| 5,615,886 | A * | 4/1997 | Chalfin et al. | 273/272 |
| 6,629,897 | B2 | 10/2003 | Belknap | |
| D506,788 | S * | 6/2005 | Weisman et al. | D21/386 |
| 7,063,620 | B2 | 6/2006 | Nearhood | |
| 8,216,078 | B1 * | 7/2012 | Yovanovich et al. | 473/40 |
| 2009/0029787 | A1 * | 1/2009 | Crosbie | 473/40 |
| 2012/0302361 | A1 * | 11/2012 | Kaplan | 473/40 |

* cited by examiner

*Primary Examiner* — Mitra Aryanpour
(74) *Attorney, Agent, or Firm* — Eric Karich

(57) ABSTRACT

A billiards rack system has a rack body and at least two alignment elements. The rack body has at least two inner surfaces that together define an inner area shaped for racking the billiard balls. The at least two alignment elements of the rack body each have an alignment indicia that is shaped to be placed over and visually aligned with alignment marks on a billiards table. The rack body correctly positions billiard balls on the billiards table once the alignment indicia of the alignment elements have been placed over and visually aligned with the alignment marks of the billiards table.

6 Claims, 3 Drawing Sheets

BILLIARDS RACK SYSTEM AND METHOD OF USE

CROSS-REFERENCE TO RELATED APPLICATIONS

This application for a utility patent is a continuation-in-part of a previously filed utility patent, still pending, having the application Ser. No. 13/269,722, filed Oct. 10, 2011.

BACKGROUND OF THE INVENTION

1. Field of the Invention

This invention relates generally to billiards racks, and more particularly to a billiards rack that includes alignment indicia for aligning the billiards rack on the billiards table.

2. Description of Related Art

The following art teaches various billiards racks for positioning billiard balls on a billiards table for the start of a game of billiards. A standard billiards rack is a simple triangular structure that holds the balls in a triangular configuration. The top ball in the rack is visually aligned with a locator mark on the pool table so that the triangular configuration of balls is correctly positioned on the table. This system is quick and easy to use, but it can provide inconsistent results because the position of the rack is only roughly approximated based upon the location of the top ball, and there is no precise control over the rotational orientation of the rack, this is merely estimated by the user.

Various forms of racks have been developed with more accurate alignment systems, generally involving the alignment of lasers mounted on the rack with particular points on the sidewalls of the pool table. Belknap, U.S. Pat. No. 6,629,897, for example, teaches a billiards rack that includes a rack locator that includes a laser and a photodetector that together cause an indicator to illuminate when the rack is correctly positioned with respect to the table.

Nearhood, U.S. Pat. No. 7,063,620, teaches another embodiment of a billiards rack that includes lasers. The light from the lasers is aligned with indicia on the billiards table for aligning the rack on the table.

While the laser systems are effective, they are more expensive, and they require batteries to be supplied and replaced. They are also more likely to be damaged or knocked out of alignment. These references are hereby incorporated by reference in full.

The prior art teaches billiards racks that include lasers that may aligned with components on the side of a billiards table. However, the prior art does not teach a billiards rack that includes alignment elements having alignment indicia that may be placed over and visually aligned with alignment marks of a playing surface of the billiards table. The present invention fulfills these needs and provides further related advantages as described in the following summary.

SUMMARY OF THE INVENTION

The present invention teaches certain benefits in construction and use which give rise to the objectives described below.

The present invention provides a billiards rack system for positioning billiard balls on a billiards table as directed by alignment marks on the billiards table. The billiards rack system comprises a rack body and at least two alignment elements. The rack body has at least two inner surfaces that together define an inner area shaped for racking the billiard balls. The at least two alignment elements of the rack body each have an alignment indicia that is shaped to be placed over and visually aligned with one of the alignment marks. The rack body correctly positions the billiard balls on the billiards table once the alignment indicia of the alignment elements have been placed over and visually aligned with the alignment marks of the billiards table.

A primary objective of the present invention is to provide a billiards rack system having advantages not taught by the prior art.

Another objective is to provide a billiards rack system that includes alignment elements having alignment indicia that may be placed over and visually aligned with alignment marks of a playing surface of the billiards table to correctly position billiard balls on a billiards table.

Another objective is to provide a billiards rack system that is quick and easy to install and to use.

A further objective is to provide a billiards rack system that is inexpensive and maintenance fee.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a billiards rack system 10 for positioning billiards balls 12 on a billiards table 14 as directed by alignment marks 18 on the billiards table 14.

Figure 1:
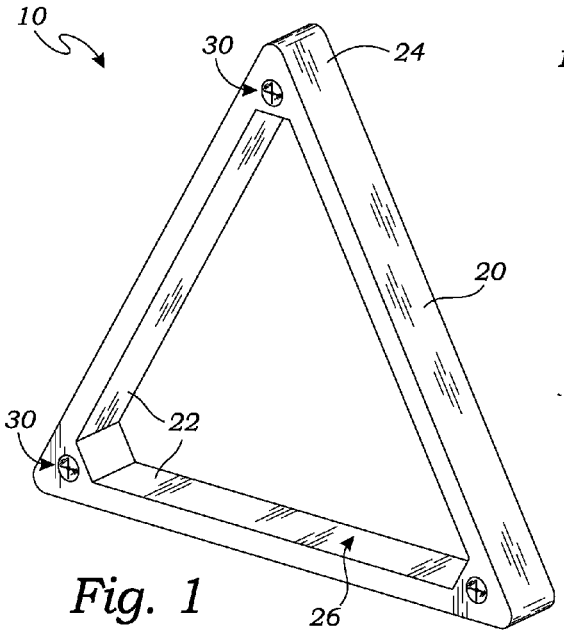
FIG. 1 is a perspective view of a billiards rack system according to one embodiment of the present invention.
Figure 2:
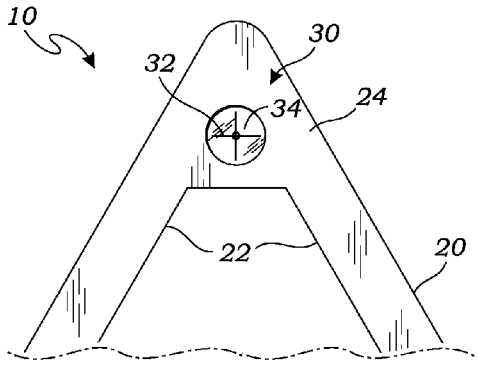
FIG. 2 is a top plan view of one corner of the billiards rack system, illustrating one of three alignment elements being aligned with one of three alignment marks on a billiards table.

FIG. 1 is a perspective view of the billiards rack system 10 according to one embodiment of the present invention. FIG. 2 is a top plan view of one corner of the billiards rack system 10. As illustrated in FIGS. 1-2, the billiards rack system 10 comprises a rack body 20 having at least two alignment elements 30, in this case three, formed by or built into the rack body 20. The at least two alignment elements 30 are required for the correct placement and rotational orientation of the rack body 20; however, additional alignment elements 30 may be provided, and there are three alignment elements 30 in the illustrated embodiment, one in each of the three corners 24 of the rack body 20. Other numbers of and placements of the alignment elements 30 may also be utilized, if desired by one skilled in the art.

The rack body 20 has at least two inner surfaces 22 that together define an inner area 26 shaped for racking the billiards balls 12 (i.e., for holding the balls 12 in a configuration desired for playing pool). The inner surfaces 22, in this case three in number, may meet at corners 24 to define the inner area 26. The general construction may be similar to prior art billiard racks, and may vary considerably in shape and design, as long as it includes the inner area 26 correctly shaped to contain and arrange the billiards balls 12. Since this aspect of the invention is well known, it is not described in greater detail herein.

The alignment elements 30 of the rack body 20 may each have an alignment indicia 32 that is shaped to be placed over and visually aligned with one of the alignment marks 18 on the billiards table 14. The alignment marks 18 are placed on the billiards table 14 at predetermined points, as discussed in greater detail below, to correctly align the rack body 20. Once the alignment indicia 32 of the alignment elements 30 have been placed over and visually aligned with the alignment marks 18 of the billiards table 14, the rack body 20 is shaped to correctly position the billiards balls 12 on the billiards table 14.

In the embodiment of FIGS. 1-2, each of the alignment elements 30 includes a transparent feature 34 that is imprinted with the alignment indicia 32. In the present embodiment, the alignment indicia 32 includes crosshairs formed on or within the transparent feature 34. The user can then look through the transparent feature 34 to locate the alignment marks 18, and move the rack body 20 so that the alignment indicia 32 is aligned with the alignment mark.

In one embodiment, the transparent feature 34 is a cylindrical component constructed of a transparent material (e.g., plastic, glass, etc.). The transparent features 34 may be shaped to magnify the alignment marks 18 on the billiards table 14, making the proper alignment easier to achieve, especially for users with weak eyesight. While one embodiment of the alignment elements 30 and the alignment indicia 32 are described herein, other structures and/or features may be used to align the rack body 20 on the billiards table 14 as described herein. For example, various forms of fingers, slots, or other structures could extend into or from the rack body 20 for the purposes of alignment with the alignment marks 18. These and other alternative embodiments should be considered within the scope of the claimed invention.

Figure 3:
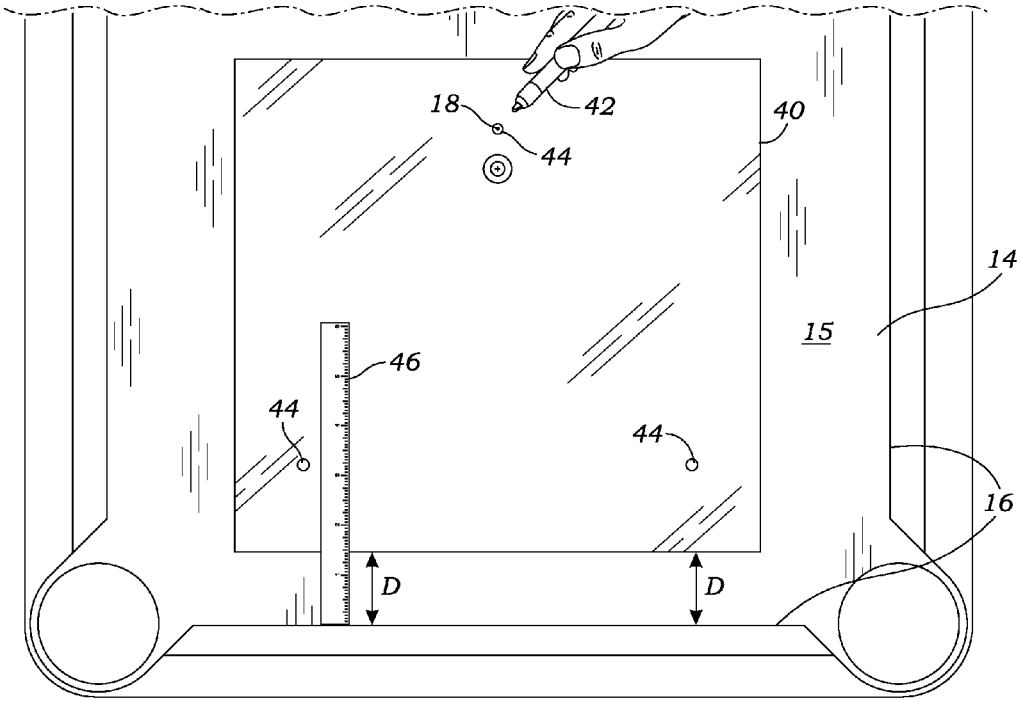
FIG. 3 is a top plan view of a template being used to form the alignment marks on the billiards table.

FIG. 3 is a top plan view of a template 40 being used to form the alignment marks 18 on the billiards table 14. In one embodiment, the template 40 may be used to more quickly and accurately make the necessary marks. In this embodiment, the alignment marks 18 are made using a marking implement 42 (e.g., a permanent marker or similar product), although other tools may be used in alternative embodiments. The template 40 of this embodiment includes apertures 44 at predetermined locations for forming the alignment marks 18. The template 40 is positioned in a predetermined location on the playing surface 15 of the billiards table 14 so that the alignment marks 18 may be marked through the apertures 44 of the template 40 and onto the playing surface 15 of the billiards table 14. The template 40 may be positioned using a ruler 46 or other measuring device so that it is correctly positioned and oriented. In another embodiment, the template 40 may be physically positioned against the side walls 16 of the billiards table 14, or using another technique.

Figure 4:
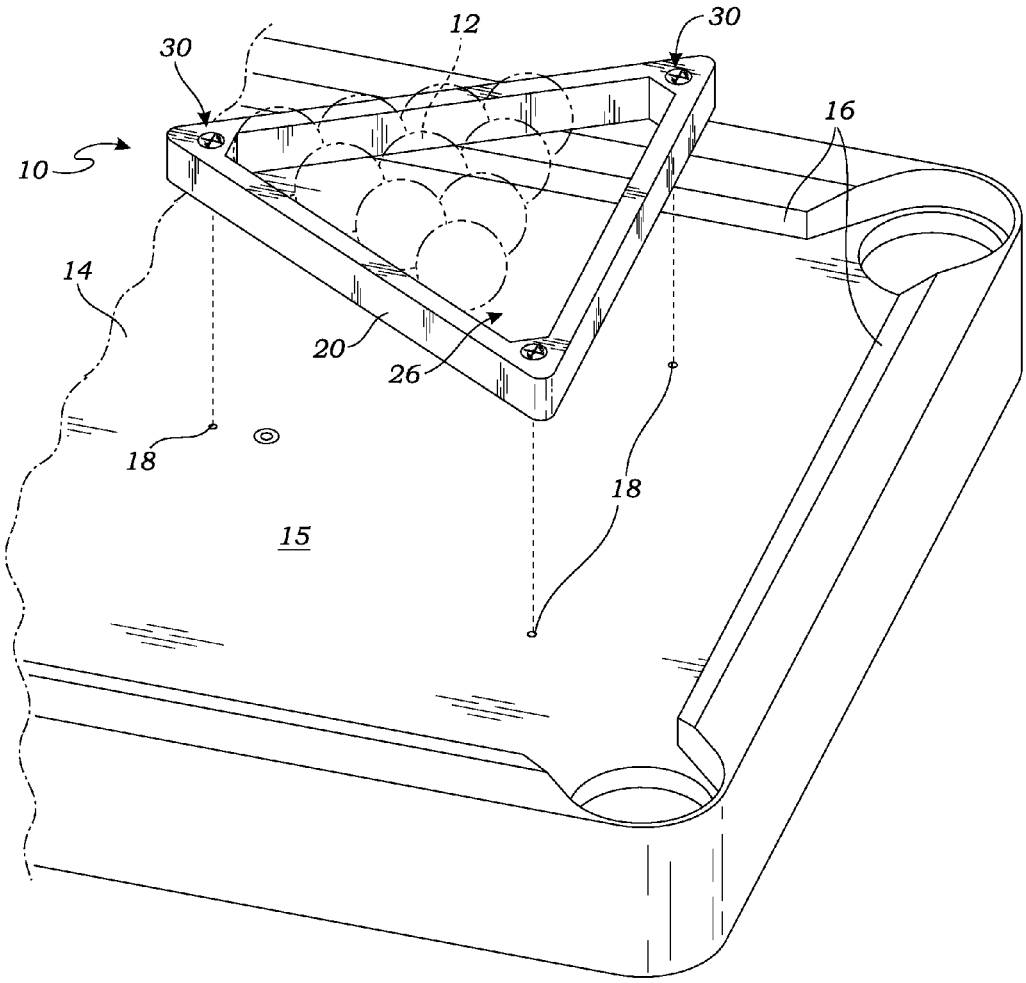
FIG. 4 is an exploded perspective view of the billiards rack system of FIG. 1 being positioned on the billiards table aligned with the alignment marks, so that billiard balls are correctly positioned on the billiards table.

FIG. 4 is an exploded perspective view of the billiards rack system 10 of FIG. 1 being positioned on the billiards table 14 aligned with the alignment marks 18, so that billiards balls 12 are correctly positioned on the billiards table 14. As illustrated in FIG. 4, the billiards rack system 10 is placed on the billiards table 14 generally over the alignment marks 18. The billiards balls 12 may be positioned within the inner area 26 of the rack body 20, as is already practiced in the prior art. The alignment indicia 32 of the alignment elements 30 are then positioned over and visually aligned with the alignment marks 18 of the billiards table 14, such that the rack body 20 correctly positions the billiards balls 12 on the billiards table 14. Once the billiards balls 12 have been correctly positioned, the billiards rack system 10 may be removed, carefully so as to not disturb the positions of the billiards balls.

Figure 5:
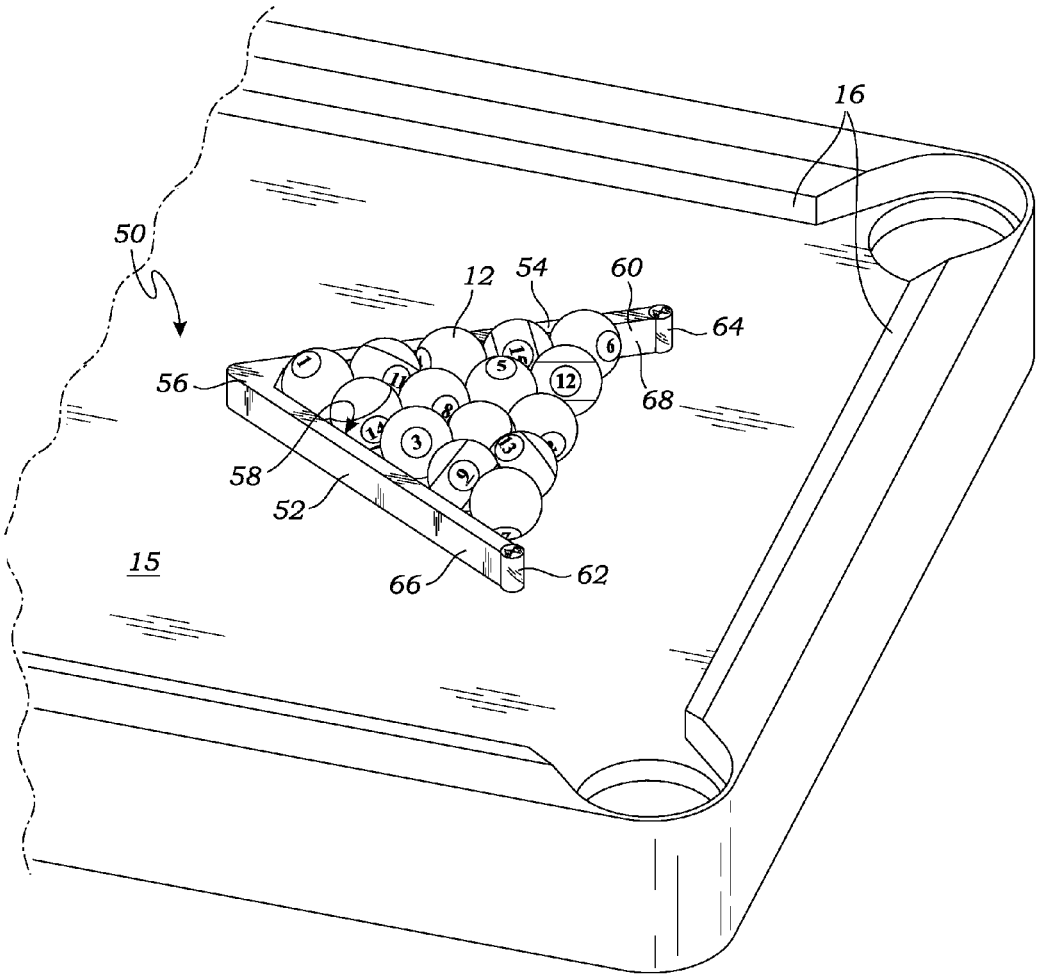
FIG. 5 is a perspective view of another embodiment of the billiards rack system.

FIG. 5 is a perspective view of another embodiment of the billiards rack system 50. As illustrated in FIG. 5, this embodiment only includes two side elements 52 and 54 extending from an apex 56 so that the side elements 52 and 54 are generally V-shaped, and extend at approximately sixty degree angles from each other (approximately being defined to include deviation that is small enough to enable proper racking of the pool balls, as described above). The two side elements 52 and 54 each provide one of the at least two inner surfaces 58 and 60, respectively, and function to correctly position the balls 12 on the table.

In this embodiment, the system 50 includes alignment elements 62 and 64 at each end 66 and 68, respectively, of the side elements 52 and 54. The alignment elements 62 and 64 may be formed of a transparent material, and attached (e.g., bonded or otherwise attached) to the ends 66 and 68.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A billiards rack system for positioning billiard balls on a billiards table as directed by alignment marks on the billiards table, the billiards rack system comprising:

a rack body having at least two inner surfaces that together define an inner area shaped for racking the billiard balls; and at least two alignment elements of the rack body, each of the at least two alignment elements being shaped to be placed over and visually aligned with one of the alignment marks, wherein each of the at least two alignment elements includes a transparent cylindrical component shaped to magnify the alignment marks, and crosshairs on or within the transparent cylindrical component; and whereby the rack body correctly positions the billiard balls on the billiards table once the crosshairs have been placed over and visually aligned with the alignment marks of the billiards table.

2. The billiards rack system of claim 1, wherein the transparent cylindrical components are positioned within corners of the rack body.

3. The billiards rack system of claim 1, wherein there are three transparent cylindrical components, one located in each of three corners of the rack body.

4. A billiards rack system for positioning billiard balls on a billiards table, the billiards rack system comprising:

alignment marks on the billiards table;

a rack body having at least two inner surfaces that together define an inner area shaped for racking the billiard balls; and at least two alignment elements of the rack body, each of the at least two alignment elements having an alignment indicia that is shaped to be placed over and visually aligned with one of the alignment marks, wherein each of the at least two alignment elements includes a transparent cylindrical component shaped to magnify the alignment marks, and crosshairs on or within the transparent cylindrical component; and whereby the rack body correctly positions the billiard balls on the billiards table once the crosshairs have been placed over and visually aligned with the alignment marks of the billiards table.

5. The billiards rack system of claim 4, wherein the transparent cylindrical components are positioned within corners of the rack body.

6. The billiards rack system of claim 4, wherein there are three transparent cylindrical components, one located in each of three corners of the rack body.

* * * * *